US006182421B1

(12) United States Patent
Sullivan

(10) Patent No.: US 6,182,421 B1
(45) Date of Patent: Feb. 6, 2001

(54) METHOD OF MANUFACTURING AN ARTICLE

(76) Inventor: John T. Sullivan, 3910 Madison St., Hyattsville, MD (US) 20781

( * ) Notice: Under 35 U.S.C. 154(b), the term of this patent shall be extended for 0 days.

(21) Appl. No.: 08/967,742

(22) Filed: Nov. 10, 1997

(51) Int. Cl.[7] ..... B65B 35/30

(52) U.S. Cl. ..... 53/438; 53/433; 53/434; 53/443; 53/447

(58) Field of Search ..... 53/438, 443, 529, 53/147, 432, 433, 434, 510, 511, 512, 447, 448, 540, 543

(56) References Cited

U.S. PATENT DOCUMENTS

| | | | |
|---|---|---|---|
| 3,306,002 | | 2/1967 | Vogt . |
| 3,334,666 | | 8/1967 | Vogt . |
| 3,381,445 | | 5/1968 | Vogt . |
| 3,392,900 | | 7/1968 | Vogt . |
| 3,399,931 | | 9/1968 | Vogt . |
| 3,446,418 | | 5/1969 | Vogt . |
| 3,450,441 | | 6/1969 | Vogt . |
| 3,467,151 | | 9/1969 | Vogt . |
| 3,468,099 | | 9/1969 | Vogt . |
| 3,481,283 | | 12/1969 | Vogt . |
| 3,490,391 | | 1/1970 | Vogt . |
| 3,500,991 | | 3/1970 | Vogt . |
| 3,561,372 | | 2/1971 | Vogt . |
| 3,586,066 | | 6/1971 | Brown . |
| 3,589,411 | | 6/1971 | Vogt . |
| 3,596,429 | | 8/1971 | Vogt . |
| 3,596,688 | | 8/1971 | Vogt . |
| 3,612,307 | | 10/1971 | Vogt . |
| 4,577,453 | * | 3/1986 | Hofeler ..... 53/529 X |
| 4,679,379 | * | 7/1987 | Cassoli ..... 53/438 |
| 5,022,218 | * | 6/1991 | Prakken ..... 53/529 |
| 5,199,245 | * | 4/1993 | Daddario et al. ..... 53/451 X |
| 5,401,156 | * | 3/1995 | Anderson ..... 53/529 X |
| 5,656,233 | * | 8/1997 | Weder et al. ..... 53/450 X |

* cited by examiner

*Primary Examiner*—Daniel B. Moon
(74) *Attorney, Agent, or Firm*—Diller, Ramik & Wight, PC

(57) ABSTRACT

A packaging method includes the steps of conveying a plurality of individual articles toward an assembly area at which the individual articles are formed into a group of articles which are then conveyed to a package area at which the group of articles can also be sized and packaged in a pouch. Preferably, the articles are balls of cotton candy, but individual articles can be similarly packaged.

40 Claims, 4 Drawing Sheets

39

60
70
10
MP
49
53
47
57
51
52
38
45
23
23
46
37
43
G
22
21
18
17
FILTER
16
VACUUM PUMP
15
TS1
B
P
TS2

39
60
70
49
53
47
57
G
10
MP
50
51
B
23
52
36
38
35
45
46
37
22
43
48
30
58
26
54
21
25
29
55
41
18
T
11
FILTER
17
16
12
$T_{S1}$
P
VACUUM PUMP
15
$T_{S2}$

METHOD OF MANUFACTURING AN ARTICLE

BACKGROUND OF THE INVENTION

U.S. Pat. No. 5,511,961 granted on Apr. 30, 1996 describes earlier machines for producing cotton candy by melting granular sugar and ejecting the same from spinning heads upon an interior surface of a tub from which the cotton candy or floss was picked-up on wooden sticks. Cotton candy lovers experienced "sticky" fingers when tearing-off "bite" size portions of cotton candy from such cotton candy cones.

In recent years a few cotton candy producers attempted crushing the natural fluffy candy into flat bricks, but this is undesirable because the "fluffiness" of the candy is destroyed.

The machine of the latter patent is capable of manufacturing "bite" size cotton candy balls on an extremely high speed basis absent labor intensiveness. However, until the present invention, the packaging of such "bite" size cotton candy balls was labor intensive.

SUMMARY OF THE INVENTION

In keeping with the foregoing, a primary object of the present invention is to provide a novel packaging machine for packaging "bite" size cotton candy balls on an extremely high speed basis absent labor intensiveness.

In accordance with the present invention, "bite" size cotton candy balls or wads are pneumatically drawn into an assembly area defining a generally cylindrical volume. At this assembly area or staging area, the cotton candy balls are assembled in a loose mass, and at a predetermined weight or volume, this loose mass of cotton candy balls are pneumatically transferred to a packaging area which is also of a generally cylindrical volume. Air is extracted from the group of cotton candy balls and substantially simultaneously therewith a plunger further compresses and pushes the group of cotton candy balls into a container which is preferably a packaging tube associated with a conventional form-and-fill machine. The plunger is retracted and subsequently the package is cross-sealed, severed and the individual package with the group of compressed cotton candy balls therein is discharged for automatic packaging in a case with similar packages. In this fashion a predetermined weight, volume and/or size of cotton candy balls is assembled as a group at the assembly area or staging area, transferred as a group to the packaging area, and discharged from the packaging area as a compressed group into an individual package absent human intervention other than machine oversight.

The packaging method thus far described is not only lacking in labor intensiveness, but the speed of packaging is extremely fast, particularly because during the transfer of a first group of cotton balls from the staging area to the packaging area, a second group of cotton candy balls are being assembled at the staging area during the package of the first group of cotton candy balls. Thus, the packaging step is not dependent upon singular cotton candy ball in-feed which would be time consuming, but instead each package is essentially filled at the packaging area with a pre-formed group of cotton candy balls of a desired weight.

The process can be further enhanced, particularly from the standpoint of high-speed production, by providing several assembly areas or staging areas, each of which is fed cotton candy balls with each group of cotton candy balls being discharged from whichever staging area or assembly area is first filled to its desired weight/capacity. In this fashion, the actual package filling can proceed at a maximum speed because immediately at the end of each filling or packaging cycle another group of cotton candy balls awaits packaging into the next package of the form-and-fill machine.

During the packaging method, the retraction of the piston might otherwise create a partial vacuum in the bag being filled, and this undesirable situation is alleviated (a) by the timed introduction of positive air pressure into the bag portion being filled or (b) by utilizing a hollow plunger within which is housed a solid rod which essentially "injects" positive air pressure into the filler tube and the bag being filled during the retraction of the plunger. Thus, each package, bag or pouch sealed conventionally by the form-and-fill machine is of a consistent size and shape, being neither deflated or inflated during the filling process. The latter is important not only from an aesthetic standpoint but also from a production and a packaging standpoint. Cross seals can be made absent wrinkling of the packaging material or product intrusion in the cross seals which might otherwise create bleed passages in the cross seals resulting in the product becoming stale over a short period of time. Further-more, since each package is of a uniform volume and size, when packaged in a case, each case appears properly filled, as is the fact, which would not otherwise be visually apparent if the packages were underinflated/deflated and thereafter cross-sealed. Thus, by the present method the aesthetics of the package exteriorly remain of high quality and shelf-life of the packaged "bite" size cotton candy is long lasting With the above and other objects in view that will hereinafter appear, the nature of the invention will be more clearly understood by reference to the following detailed description, the appended claims and the several views illustrated in the accompanying drawings.

DESCRIPTION OF THE PREFERRED EMBODIMENTS

Figure 1:
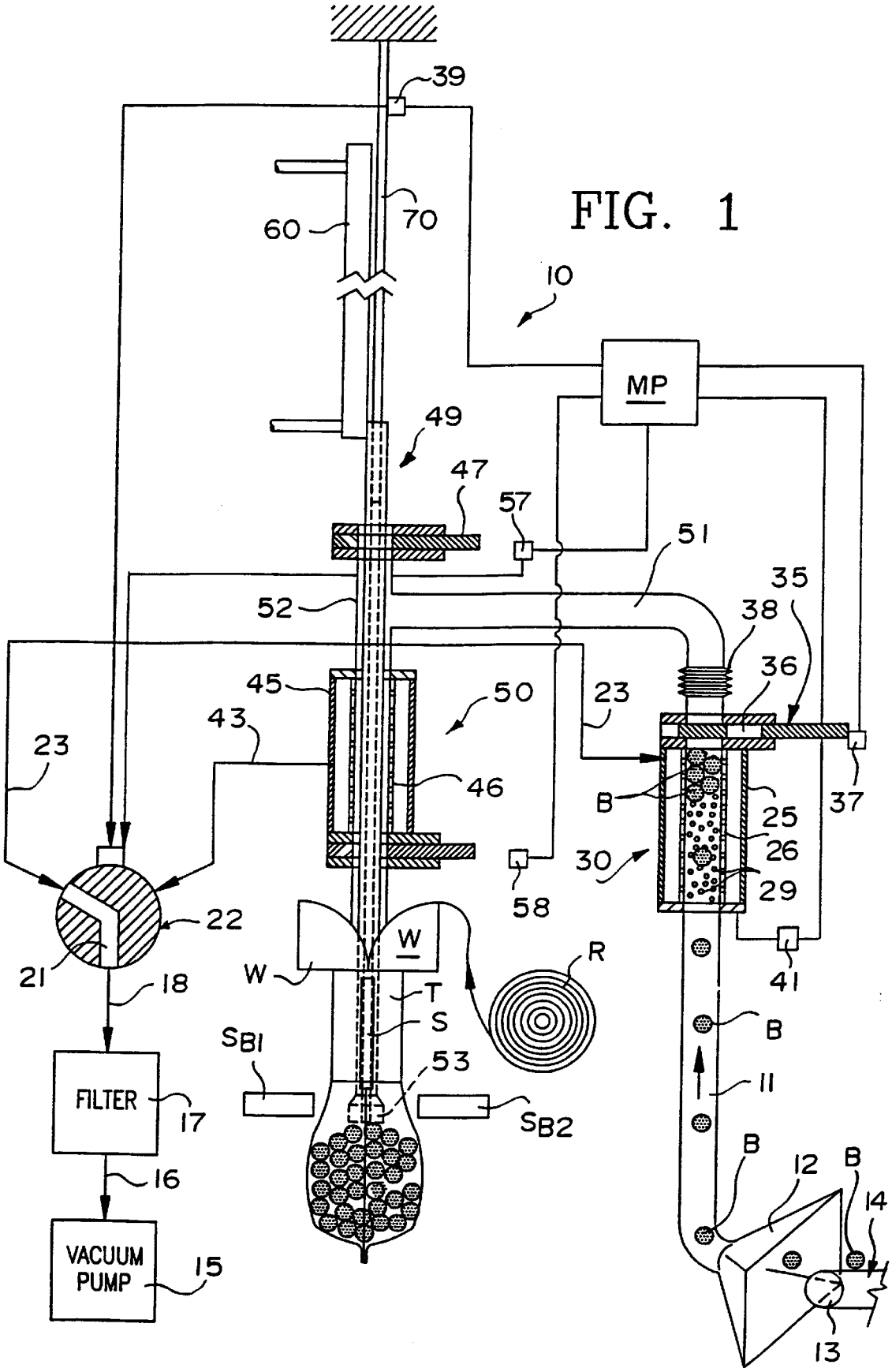
FIG. 1 is a highly schematic side elevational view of a novel packaging machine of the present invention, and illustrates a plurality of "bite" size cotton candy balls or similar products being fed to an assembly area or staging area contemporaneously with an earlier "grouped" group of cotton candy balls being inserted by a plunger through a filling tube into a flexible package or tube of a conventional formand-fill machine.

A novel machine for packaging cotton candy balls B and similar articles, either individually or collectively, in groups is generally designated by the reference numeral 10 (FIGS. 1 through 4).

Figure 2:
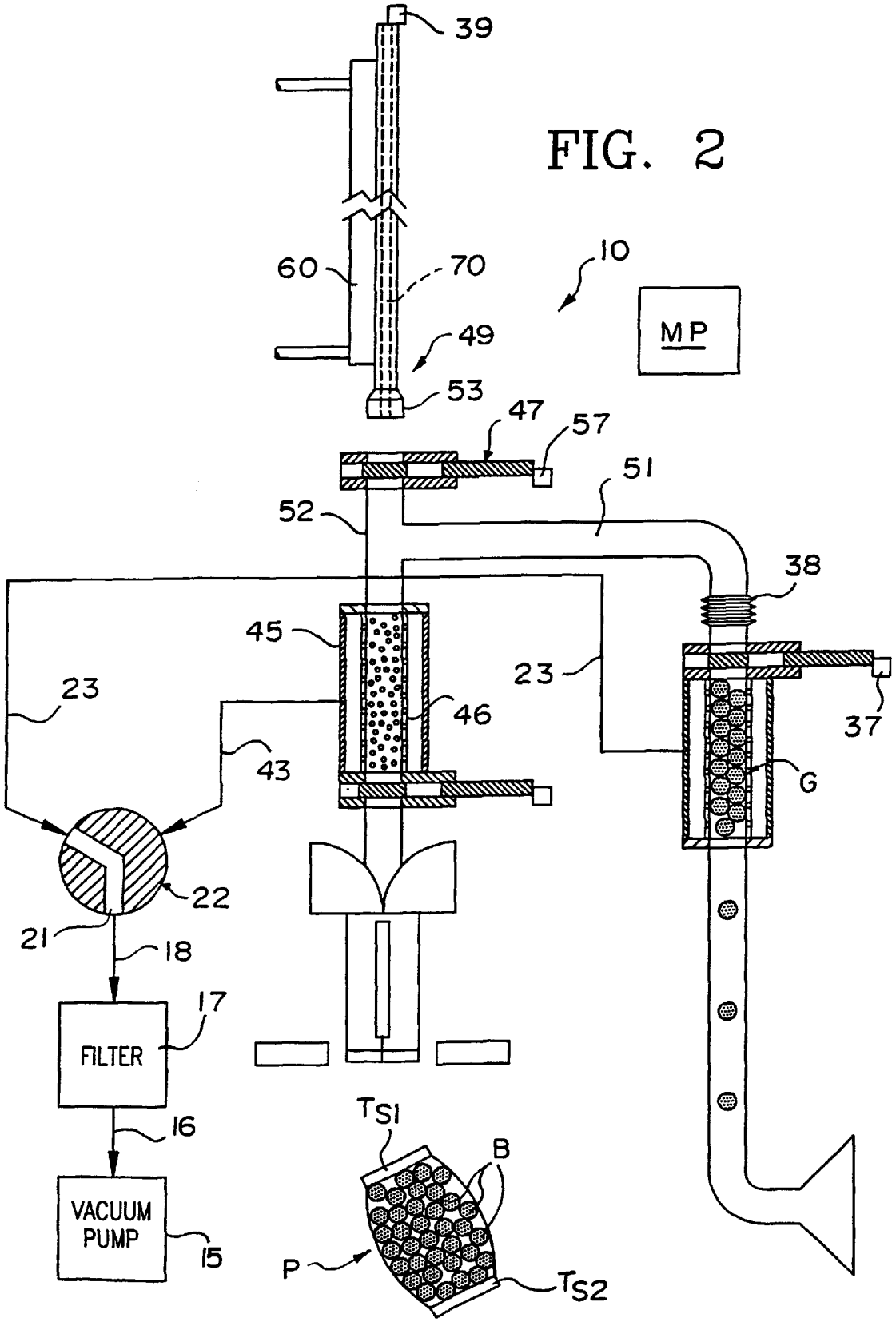
FIG. 2 is a schematic side elevational view similar to FIG. 1, and illustrates the plunger of FIG. 1 being retracted and a proper weight of grouped cotton candy balls at the staging area incident to discharge therefrom to the packaging area.

The packaging machine 10 includes an inlet pipe, conduit or tube 11 having a funnel-like inlet end portion 12 located adjacent a discharge end 13 of a conventional conveyor 14 upon which are conveyed cotton candy balls B of different colors and flavors which preferably are manufactured upon machines of the type disclosed in U.S. Pat. No. 5,511,961. The cotton candy balls B are preferably drawn under vacuum or negative air pressure into the funnel-like inlet end portion 12 of the inlet pipe 11 by a vacuum created by a conventional vacuum pump 15 which is in turn connected to a line 16 exiting a conventional air filter 17. A line 18 is in selective communication with a port 21 of an electrically adjustable valve 22. In the position illustrated in FIG. 1, the port 21 communicates with a line 23 which is in turn connected to an exterior imperforate cylindrical sleeve or housing 25 which is in spaced surrounding relationship to an inner perforated cylindrical sleeve or tube 26 defining an assembly area or a staging area of a cylindrical volume which is generally designated by the reference character 30. Though only a single staging area 30 is disclosed herein, it is to be understood that a plurality of such identical staging areas 30 can be provided and fed cotton candy balls B via the line 23 or a duplicate thereof. Air is drawn through individual perforations 29 of the perforated tube 26 which draws the balls B upwardly along the interior of the inlet pipe 11 and into the perforated sleeve 26 eventually filling the same (FIG. 2). An upper end (unnumbered) of the perforated sleeve 26 is selectively opened and closed by a shutter valve or plate valve 35 which in FIG. 1 is shown in its closed position but includes a circular opening 36 which can be aligned with the perforated tube 26 to discharge the cotton candy balls B therefrom in an upward direction as a group G (FIGS. 2 and 3), as will be described more fully hereinafter. A limit switch/control switch 37 of a conventional construction is connected to a conventional microprocessor MP having conventional circuitry for controlling the overall operation of the packaging machine 10 in a conventional manner.

The overall staging area 30 is suspended from a tubular expandable/contractible flexible bellows 38, and is a part of a conventional weighing machine, such as is disclosed in U.S. Pat. No. 3,589,411 having associated therewith a conventional load cell or strain gauge 41 which detects the weight of the cotton candy balls B as they are accumulated in the perforated sleeve 26. The load cell or sensor 41 is also connected to the microprocessor MP and when the group G (FIG. 2) of cotton candy balls B reaches a predetermined weight, the microprocessor MP generates a signal which moves the shuttle plate valve 35 to its open position (FIG. 3) while at substantially the same time the microprocessor MP operates the valve 22 to move the port 21 thereof to the position shown in FIG. 3, namely, closing off communication between the vacuum pump 15 and the sleeve 26 via the line 23 and establishing communication between the port 21 and a line 43 connected to an exterior imperforate sleeve or housing 45 interiorly of which is a perforated sleeve, housing or tube 46 which in conjunction with shutter valves or plate valves 47, 48 and a plunger mechanism 49 defines a packaging area or filling area 50.

The vacuum or negative air pressure drawn through the line 43 conveys the group G of cotton candy balls B from the perforated tube 26 upwardly and through a transition pipe or tube 51 toward and into a vertical filling pipe 52 which is in axial alignment with a plunger 53 of the plunger mechanism 49. The perforated sleeve 46 and a lower aligned filler tube 54 are components of a conventional form-and-fill machine 55. As is best illustrated in FIG. 3, the shutter valves or plate valves 47, 48 controlled by respective conventional solenoids/limit switches 57, 58 are closed and thus the group G of cotton candy balls B exiting the transition tube 51 descend into the filling pipe 52 and fill the volume of the perforated sleeve 46 at the package area 50.

Figure 3:
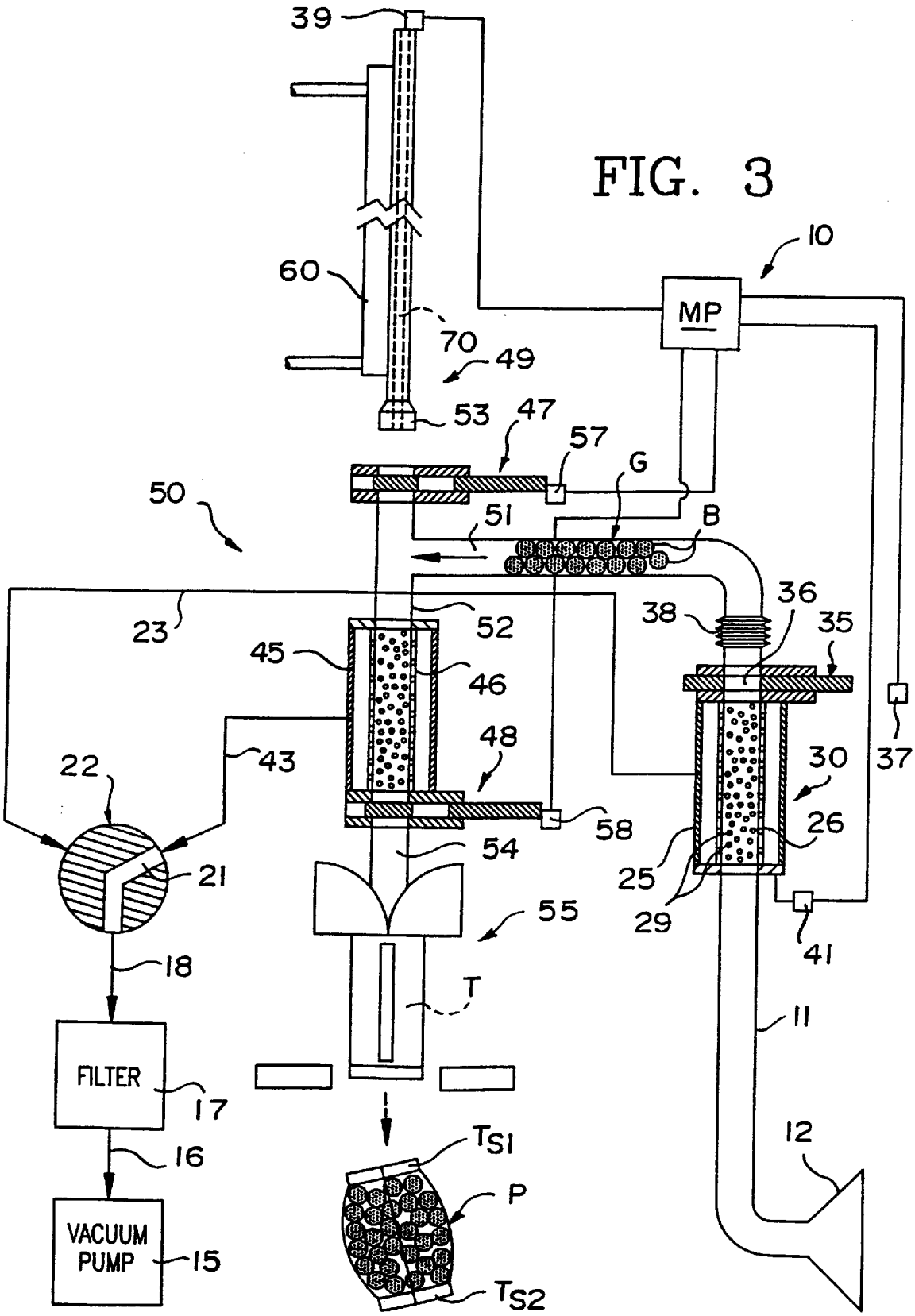
FIG. 3 is another schematic side elevational view of the machine of FIGS. 1 and 2, and illustrates the group of cotton candy balls being transported from the staging area to the packaging area.
Figure 4:
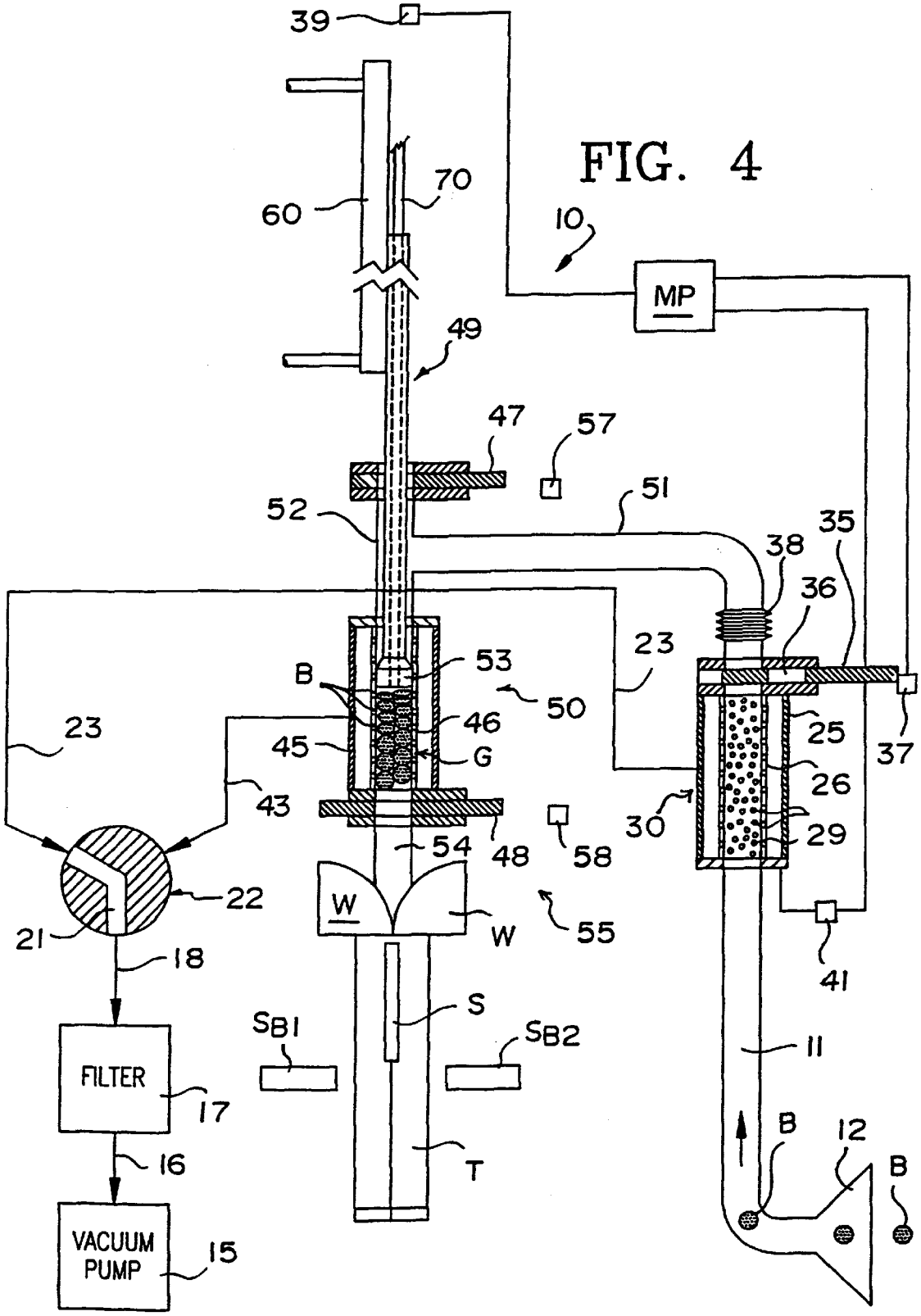
FIG. 4 is another schematic side elevational view similar to FIGS. 1 through 3 of the drawings, and illustrates the plunger descending to slightly compress and eventually discharge the group of cotton candy balls into the pouch, tube container or package during the formation thereof, while another group of cotton candy balls are being assembled in the staging area.

Once the group G of cotton candy balls B have filled the sleeve 46, the microprocessor MP operates a solenoid/limit switch 39 to cause a rod of a conventional fluid piston motor 60 (FIG. 4) connected to the plunger 53 to drive the plunger 53 downwardly from the position shown in FIG. 3 towards the position shown in FIG. 2 causing slight compression of the balls B due to the frictional engagement of the latter against the inner surface of the perforated sleeve 46 and the pneumatic negative air pressure "holding" the balls B within the perforated sleeve 46. Incident to the descent of the plunger 53, the microprocessor MP also energizes the appropriate solenoid 58 to open the shutter valve 48 whereupon the compressed group G of the cotton candy balls B descend through the filler tube 54 into a flexible packaging tube T surrounding the filler tube 54 of the conventional form-and-fill machine 55. The tube T is drawn from a roll R (FIG. 1) of web material and is transformed into the tube T by a conventional forming wing W of the form-and-fill machine 55 which also includes a longitudinal sealer S and transverse sealing bars SB1, SB2 which are relatively moved toward and away from each other to form a transverse seal after the group G of cotton candy balls B have been totally inserted into the lower end of the tube T and the plunger 53 has been retracted to its uppermost position (FIGS. 1 and 2). The transverse sealing bars SB1, SB2 form transverse seals Ts1, Ts2 (FIGS. 2 and 3) and essentially simultaneously therewith the sealed tube T is immediately transversely severed transforming the tube T into the pouch P shown being discharged in FIG. 3. The process is repeated with, of course, another group G of cotton candy balls B having been fed into, grouped and weighed at the staging area 30 between the time the first group G was discharged, the plate valve 35 was closed and the plunger 53 was descended and subsequently retracted, once again arriving at the position shown in FIG. 2 of the drawings at which point the packaging process is performed repetitiously.

A rod 70 (FIGS. 1 and 4) is in internal telescopic relationship to the plunger 53 and its upper end (unnumbered) is stationarily fixed to a support. The purpose of the rod 70 is to assure that as the plunger 53 is retracted from the position shown in FIG. 1, air will not be exhausted from the tube T prior to being transversely sealed to form the pouch P, as might otherwise occur to deflate the pouch P. As can be best visualized in FIG. 1, as the rod 70 remains stationary and the plunger 53 is lifted upwardly, air within the plunger exhausts from its lower end into and subsequently upwardly and outwardly from the filler tube 54 assuring that a partial vacuum or reduced pressure is not created within the tube T or the pouch P, particularly prior to or during the transverse sealing of the latter.

While the apparatus 10 and its associated method has been thus far described in association with feeding and packaging a group G of individual products B from an appropriate source (conveyor 14, for example), the apparatus 10 can also package singular, individual products. For example, an individual product can be conveyed by the vacuum from the conveyor 14 into the perforated sleeve 26 which would function strictly as a staging area, not necessarily a weighing area. This would assure high speed filling at the packaging area 50, particularly if several staging areas 35 were provided in conjunction with each packaging area 50. The method might, for example, be advantageously utilized to package products which are extremely difficult to package manually or automatically, such as pantyhose. However, pantyhose exiting the conveyor 14 would be drawn upwardly through the inlet pipe 11 and into the perforated sleeve 26 by the vacuum which would automatically gather the pantyhose into a slightly compressed homogeneous mass accommodated substantially entirely within the perforated sleeve 25. Thus, a loose pair of pantyhose would take on a "grouped" configuration in the sense of being slightly compressed or "bunched" which subsequently allows ease of further transportation through the transition pipe 51 and into the perforated sleeve 46 as well as ejection outwardly from the latter by the plunger 53 and subsequent packaging in each package P. Thus, though the invention is particularly adapted to assemble and package a plurality of individual products B as a group G, the same is equally operative for packaging singular products of virtually any type, size, consistency.

In lieu of the negative air pressure supplied by the vacuum pump 15, positive air pressure can be used to move the plurality of individual products B along the tube 11 into the perforated sleeve 26 and as a group G out from the perforated tube 26 into the packaging area 50 and specifically into the perforated sleeve 46. A source of positive air pressure might, for example, be disposed adjacent the funnel-like inlet end portion 12 of the tube 11 to blow the cotton candy balls B or other items from the conveyor 14 into and along the tube 11, the tube 51 and the tube 52 into the perforated sleeve 46. The tubes 11, 51 and 52 can also be perforated and positive air pressure can be introduced into such perforations in a direction to convey the balls B therealong into the perforated sleeve 46. Obviously, both positive and negative pressure can be used selectively as need be to effect appropriate conveyance of the balls B from the inlet end portion 12 into the perforated sleeve 46.

Although a preferred embodiment of the invention has been specifically illustrated and described herein, it is to be understood that minor variations may be made in the apparatus without departing from the spirit and scope of the invention, as defined the appended claims.

I claim:

1. A method of packaging a plurality of individual articles in a container comprising the steps of:

(a) conveying a plurality of individual articles toward an assembly area;

(b) assembling the conveyed articles into a group of articles at the assembly area and weighing the group of articles at the assembly area until a predetermine group weight of the group of articles is achieved;

(c) conveying the weighed group of articles upon achieving the predetermined group weight thereof to a sizing area;

(d) altering the size of the weighed group of articles at the sizing area;

(e) conveying the weighed and sized group of articles to a packaging area; and (f) packaging the weighed and sized group of articles in a container at the packaging area.

2. The packaging method as defined in claim 1 wherein the conveying of step (a) is performed under the influence of negative air pressure.

3. The packaging method as defined in claim 1 wherein the conveying of step (a) and step (c) is performed under the influence of negative air pressure.

4. The packaging method as defined in claim 1 wherein the conveying of step (c) is performed under the influence of negative air pressure.

5. The packaging method as defined in claim 1 wherein the conveying of at least one of step (a) and step (c) is performed under the influence of negative air pressure.

6. The packaging method as defined in claim 1 wherein the assembling of step (b) is performed under the influence of negative air pressure.

7. The packaging method as defined in claim 1 wherein the altering of step (d) is performed by compacting the weighed group of articles.

8. The packaging method as defined in claim 1 wherein the altering of step (d) is performed by compacting the weighed group of articles in a chamber.

9. The packaging method as defined in claim 1 wherein the altering of step (d) is performed by mechanically compacting the weighed group of articles.

10. The packaging method as defined in claim 1 wherein the altering of step (d) is performed by compacting the weighed group of articles while the weighed group of articles are subject to atmospheric pressure.

11. The packaging method as defined in claim 10 wherein the conveying of step (a) and step (c) is performed under the influence of negative air pressure.

12. The packaging method as defined in claim 1 wherein the altering of step (d) is performed by compacting the weighed group of articles in a chamber and venting the chamber to atmosphere.

13. The packaging method as defined in claim 1 wherein the altering of step (d) is performed by mechanically compacting the weighed group of articles and venting the chamber to atmosphere.

14. The packaging method as defined in claim 1 wherein the altering of step (d) is performed by compacting the weighed group of articles in a chamber utilizing a piston head movable in the chamber.

15. The packaging method as defined in claim 1 wherein the altering of step (d) is performed by compacting the weighed group of articles in a chamber utilizing a piston head movable in the chamber while venting the chamber to atmosphere.

16. The packaging method as defined in claim 1 wherein the altering of step (d) is performed by compacting the weighed group of articles in a chamber utilizing a piston head movable in the chamber while venting the chamber to atmosphere through the piston head.

17. The packaging method as defined in claim 1 wherein the assembling of step (b) is performed under the influence of negative air pressure within a chamber.

18. The packaging method as defined in claim 1 wherein the assembling of step (b) is performed under the influence of negative air pressure within a perforated chamber.

19. The packaging method as defined in claim 1 wherein the altering of step (d) is performed within a chamber.

20. The packaging method as defined in claim 1 wherein the altering of step (d) is performed within a chamber vented to atmosphere.

21. The packaging method as defined in claim 1 wherein the altering of step (d) and the conveying of step (e) are each performed at least in part by a reciprocally movable piston which compacts the weighed group of articles during the performance of step (d) and pushes the compacted weighed group of articles from the sizing area toward the packaging area during the performance of step (e).

22. The packaging method as defined in claim 1 wherein the individual articles are each a piece of cotton candy.

23. The packaging method as defined in claim 1 wherein the individual articles are each a substantial ball of cotton candy.

24. The packaging method as defined in claim 1 wherein the individual articles are each a piece of colored cotton candy.

25. The packaging method as defined in claim 1 wherein the individual articles are each a substantial ball of colored cotton candy.

26. The packaging method as defined in claim 1 wherein step (b) and step (d) are each performed in a chamber.

27. The packaging method as defined in claim 1 wherein step (b) and step (d) are each performed in a chamber at least one of which is under negative air pressure.

28. The packaging method as defined in claim 1 wherein step (b) and step (d) are each performed in a chamber at least one of which is vented to atmosphere.

29. The packaging method as defined in claim 1 wherein step (b) and step (d) are each performed in a chamber at least one of which is under negative air pressure and the other of which is vented to atmosphere.

30. A method of packaging a weighed and sized group of articles in a container comprising the steps of:

(a) conveying a plurality of individual articles substantially sequentially toward an assembly area under the influence of positive air pressure;

(b) assembling the substantially sequentially conveyed articles into a group of articles at the assembly area while substantially continuously monitoring the weight thereof until a predetermined group weight of articles is achieved;

(c) conveying the weighed group of articles uron achieving the predetermined group weight thereof to a sizing area;

(d) altering the size of the weighed group of articles at the sizing area;

(e) conveying the weighed and sized group of articles to a packaging area; and (f) packaging the weighed and sized group of articles in a container at the packaging area.

31. The packaging method as defined in claim 30 wherein the conveying of step (e) is performed under the influence of positive air pressure.

32. A method of packaging a plurality of individual articles in a container comprising the steps of:

(a) conveying a plurality of individual articles toward an assembly area;

(b) assembling the conveyed articles into a group of articles at the assembly area;

(c) conveying the group of articles to a sizing area;

(d) altering the size of the group of articles at the sizing area;

(e) conveying the sized group of articles to a packaging area;

(f) packaging the sized group of articles in a container at the packaging area;

(g) performing at least one of the steps (e) and (f) by utilizing a piston head movable against the group of articles while in a chamber; and (h) venting the chamber to atmosphere through the piston head.

33. The packaging method as defined in claim 32 wherein the piston head is moved by a piston rod, and step (h) is performed by venting the chamber to atmosphere through both the piston head and the piston rod.

34. A method of packaging a plurality of articles in a container comprising the steps of:

(a) conveying the articles substantially sequentially to a weighing area;

(b) continuously weighing the articles at the weighing area until a predetermined group weight of grouped articles is achieved;

(c) conveying the grouped articles of predetermined group weight to a packaging area;

(d) compressing the grouped articles in a chamber of the packaging area by moving a piston head against the grouped articles while simultaneously reducing the volume of the chamber;

(e) venting air from the chamber during the performance of step (d) through the piston head to thereby prevent adverse vacuum or air pressure conditions in the chamber; and (f) packaging the grouped articles in a container after the venting thereof.

35. The method as defined in claim 34 wherein step (f) is performed by movement of the piston head to eject the grouped articles from the chamber and into a container.

36. The method as defined in claim 34 including the steps of forming a tubular length of material, cross sealing the tubular length of material to form an open pocket, performing step (f) by ejecting the grouped articles from the chamber and into the open pocket by continued movement of the piston head, and cross sealing the open pocket to close the same and form the container with the grouped articles packaged therein.

37. The method as defined in claim 34 wherein the piston head is moved by a piston rod, and step (e) is performed by venting the chamber to atmosphere through both the piston head and the piston rod.

38. The method as defined in claim 37 including the steps of forming a tubular length of material, cross sealing the tubular length of material to form an open pocket, performing step (f) by ejecting the grouped articles from the chamber and into the open pocket by continued movement of the piston head, and cross sealing the open pocket to close the same and form the container with the grouped articles packaged therein.

39. The method as defined in claim 37 wherein step (f) is performed by movement of the piston head to eject the grouped articles from the chamber and into a container.

40. The method as defined in claim 39 including the steps of forming a tubular length of material, cross sealing the tubular length of material to form an open pocket, performing step (f) by ejecting the grouped articles from the chamber and into the open pocket by continued movement of the piston head, and cross sealing the open pocket to close the same and form the container with the grouped articles packaged therein.

* * * * *